United States Patent [19]

Krause

[11] 4,182,001

[45] Jan. 8, 1980

[54] SURFACE CLEANING AND RINSING DEVICE

[76] Inventor: Helmuth W. Krause, 185 Greens Farms Rd., Westport, Conn. 06880

[21] Appl. No.: 875,516

[22] Filed: Feb. 6, 1978

Related U.S. Application Data

[63] Continuation-in-part of Ser. No. 531,677, Dec. 11, 1974, abandoned, which is a continuation of Ser. No. 341,576, Mar. 15, 1973, abandoned.

[51] Int. Cl.[2] ..... A47L 11/34; A47L 7/00

[52] U.S. Cl. ..... 15/320; 15/385

[58] Field of Search ..... 15/320, 321, 385

[56] References Cited

U.S. PATENT DOCUMENTS

| | | | |
|---|---|---|---|
| 863,257 | 8/1907 | Blanchard | 15/385 X |
| 982,408 | 1/1911 | Alloway | 15/385 X |
| 2,168,692 | 8/1939 | Vidal | 15/320 |
| 2,622,254 | 12/1952 | Mendelson | 15/320 X |
| 3,619,848 | 11/1971 | Salzmann | 15/320 |
| 3,624,668 | 11/1971 | Krause | 15/385 X |
| 3,644,960 | 2/1972 | Danzig | 15/322 |
| 3,663,984 | 5/1972 | Anthony et al. | 15/321 |

FOREIGN PATENT DOCUMENTS

| | | | |
|---|---|---|---|
| 576560 | 5/1933 | Fed. Rep. of Germany | 15/385 |

*Primary Examiner*—Christopher K. Moore
*Attorney, Agent, or Firm*—Parmelee, Johnson, Bollinger & Bramblett

[57] ABSTRACT

A surface cleaning and rinsing device has a rotor rotatable in a housing with the underside of the rotor being provided with a plurality of suction nozzles and a plurality of orbitally rotating brushes positioned between said suction nozzles. Adjustable spray nozzles are also provided on the underside of the rotor for spraying a cleaning liquid onto the surface to be cleaned in advance of the brushes with respect to the direction of rotation of the rotor, or liquid supply means dispenses the liquid through the brushes themselves, with each of the suction nozzles serving to extract the liquid and loosened dirt immediately after brushing has occurred. The outer peripheries of the brushes are caused to rotate in the opposite direction from the rotor itself, and the brushes are turning at a rotational speed significantly faster than the rotor; therefore, they are able to lift up and flip over the pile of a rug being cleaned for also cleansing the underside of the pile. An advantageous cyclical scrubbing action on the pile is produced, in which the liquid-dwell-time is machine controlled, and very little over-all liquid is required per square yard of floor covering for achieving thorough cleaning and rinsing.

14 Claims, 13 Drawing Figures

40
50
56
59
52
54
30
60

50
30
31
41
44
43
47
48
49
57
58
45
3
60

SURFACE CLEANING AND RINSING DEVICE

This application is a continuation-in-part of copending Ser. No. 531,677, filed Dec. 11, 1974, now abandoned, which was a continuation of Serial No. 341,576, filed Mar. 15, 1973, now abandoned.

The present invention relates to a device for the cleaning and rinsing of surfaces, including rugs, and more particularly, to such a device provided with orbitally rotating brushes for coaction with cleaning liquid spraying means and suction nozzles.

Floors and coverings for floors, such as rugs, carpeting, and the like, are generally cleaned by applying a cleaning liquid to the surface, scrubbing the surface with the cleaning liquid, and then picking up the cleaning liquid together with dirt loosensed from the surface by means of a vacuum or sponges. Various forms of equipment have been devised for carrying out this cleaning process. The equipment is so constructed so as to be movable over the surface to be cleaned by the operator. While moving, the equipment applies a cleaning solution to the surface, scrubs the surface by means of a brush arrangement so as to apply the cleaning liquid thoroughly to the surface, and then picks up the solution and dirt by means of suction nozzles positioned on the underside of the equipment. Such equipment generally comprises a rotary member on the underside of which is provided a nozzle arrangement for spraying cleaning or rinsing liquid, brushes for scrubbing the surface, and nozzles for applying suction to the surface to pick up the liquid. Problems have been encountered in the actual cleaning of the surface since difficulties have arisen in providing a suitable combination of brushes, suction nozzles, and cleaning liquid sprays which would adequately clean the surface. Various forms of moving brush arrangements and other structures have been provided in an attempt to thoroughly scrub the surface with the cleaning liquid.

Not only is it desirable that a suitable brush arrangement thoroughly work the cleaning liquid into the surface, but this must be done quickly so that the cleaning liquid together with dirt which it has loosened can thereafter be picked up by the suction nozzles which immediately follow the scrubbing brushes. If the proper time relationship does not exist between the scrubbing brushes, cleaning liquid sprays, and suction nozzles, all of the dirt and cleaning liquid will not be picked up, and the result will be that the surface will not become as completely cleaned as it should be.

In all prior art apparatus of which I am aware, the dwell time (or lapse of time) between the application of the liquid to the floor covering and its extraction therefrom is dependent on the progression rate at which the operator moves the equipment over the floor. Thus, great variations in liquid-dwell-time, overwetting, insufficient cleaning, and other sources of error occur in actual practice with prior machines.

One of the objects of the present invention is to provide improved cleaning and rinsing apparatus for onlocation cleaning of floor surfaces and coverings for floors.

Another object of the present invention is to provide such a cleaning and spraying apparatus having an improved arrangement of scrubbing brushes.

Advantageously, the periphery of each brush is caused to travel in the opposite direction from the scrubbing rotor assembly as a whole, and at a higher RPM than the rotor assembly, whereby the pile of a rug is lifted up by the contrarotating brushes and is cleansed on the underside and on top.

According to one aspect of the present invention a surface cleaning and rinsing device may comprise a housing disposed substantially parallel to the surface to be cleaned with a face of the housing directed to the surface being open. A rotor is mounted for rotation within the housing and is disposed within the opening. A plurality of suction nozzles are spaced on the underside of the rotor, and means are provided within the rotor for connecting the nozzles to a vacuum source, so as to establish a suction therein. A plurality of orbitally rotating brushes are mounted on the underside of the rotor and are disposed between the suction nozzles, with each of the suction nozzles serving to extract the cleaning liquid and loosened dirt immediately after brushing has occurred. Rotating drive means are provided for rotating the brushes in the opposite direction from that in which the rotor is turning and at a significantly higher RPM than the rotor itself. Thus, the contrarotating brushes pick up or flip over the pile of the rug being cleaned whereby the pile also becomes scrubbed on its underside for producing a much more thorough scrubbing action on the pile than occurs when the brushes are rotated in the same direction as the rotor. Spray nozzle means are also provided ahead of each brush for spraying a cleaning liquid therefrom. In an alternate form, the detergent or cleaning liquid can be dispersed through the brushes.

The apparatus embodying this invention produces an advantageous cyclic scrubbing action on the pile, in which the underside and upperside of the matted pile are alternately exposed and scrubbed. Moreover, the dwell time of the liquid between application and extraction is automatically controlled by the machine and not by the human operator. In actual practice using this apparatus, only approximately 1-10th as much cleaning or rinsing liquid is required per unit area of floor covering to achieve a thorough cleaning, as compared to most of the prior art rug cleaning machines.

Other objects, advantages and features of the present invention will become apparent from the accompanying description and drawings, which are merely exemplary.

In the drawings.

Proceeding next to the drawings wherein like reference symbols indicate the same parts throughout the various views, a specific embodiment of the present invention will be described in detail.

Figure 1:
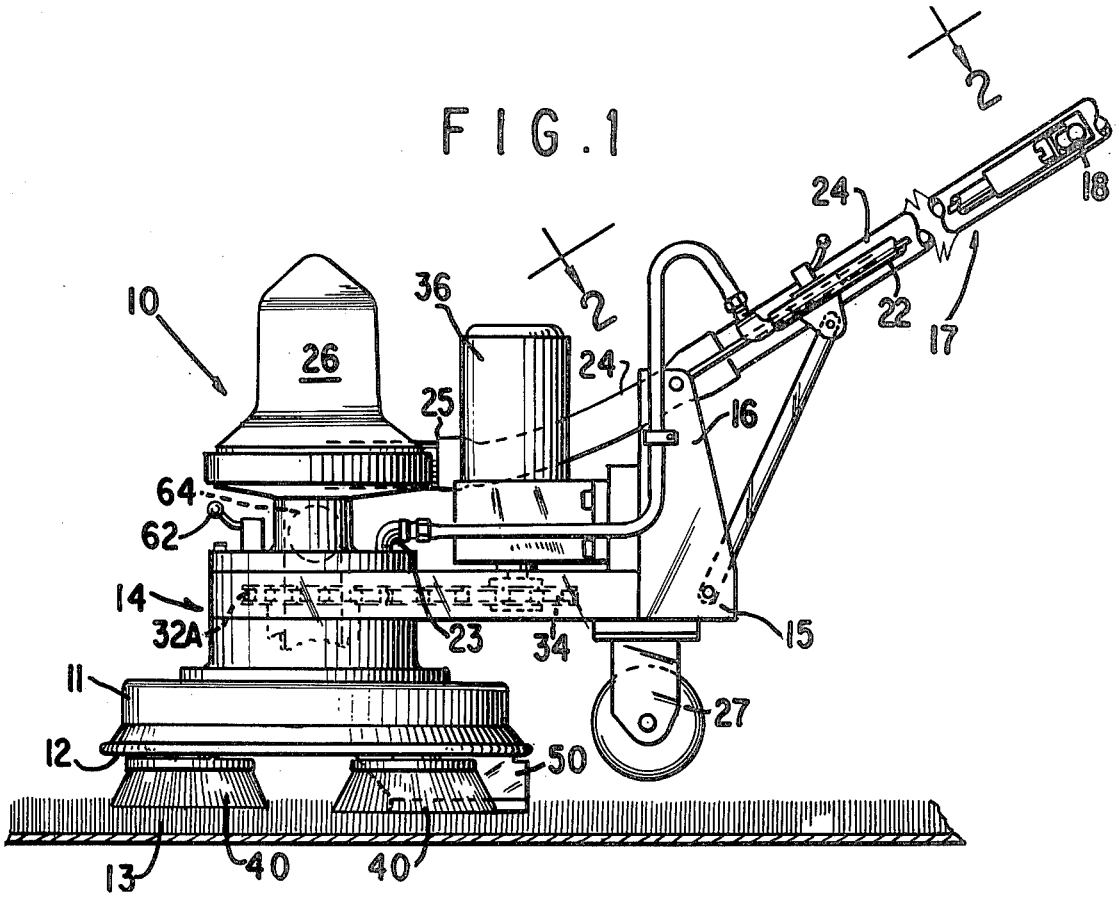
FIG. 1 is a side elevational view of the cleaning apparatus embodying the present invention being used to clean a rug.
Figure 2:
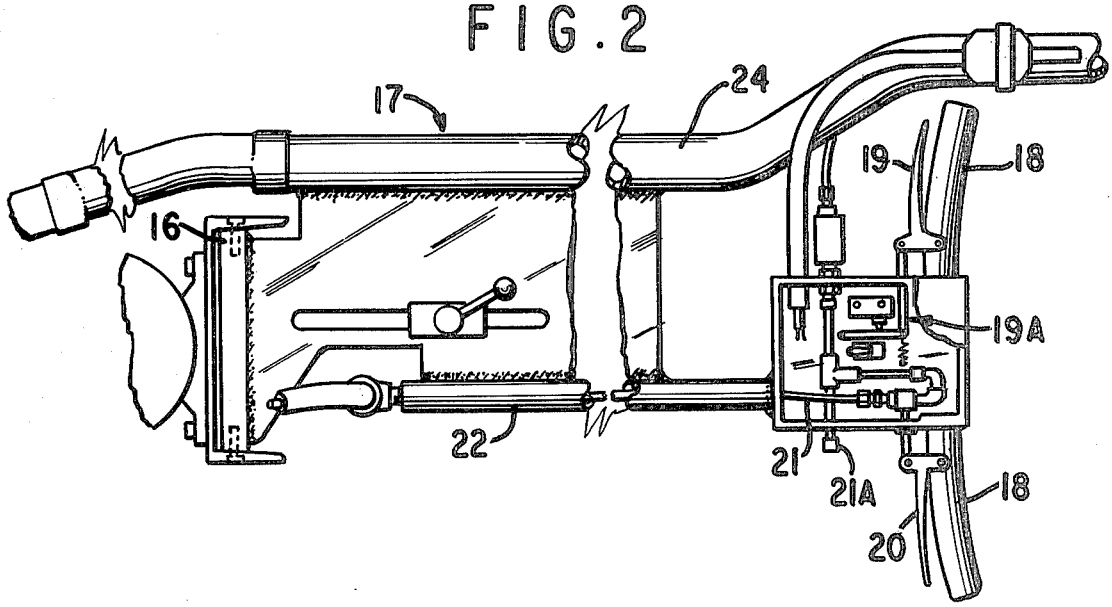
FIG. 2 is an enlarged top plan view of the control panel located on the handle of the cleaning device taken in the direction of line 2—2 in FIG. 1.

As may be seen in FIGS. 1 and 2, surface cleaning and rinsing apparatus is indicated generally at 10 which comprises a substantially circular housing and frame 11 with its lower axial face open at 12 with this face 12 being disposed substantially parallel to the surface which is to be cleaned, such as a rug 13.

Mounted on top of the housing and frame 11 is an enclosure 14 from which extends a supporting frame 15 which piviotally carries at 16 (FIG. 2) a handle assembly 17.

Figure 3:
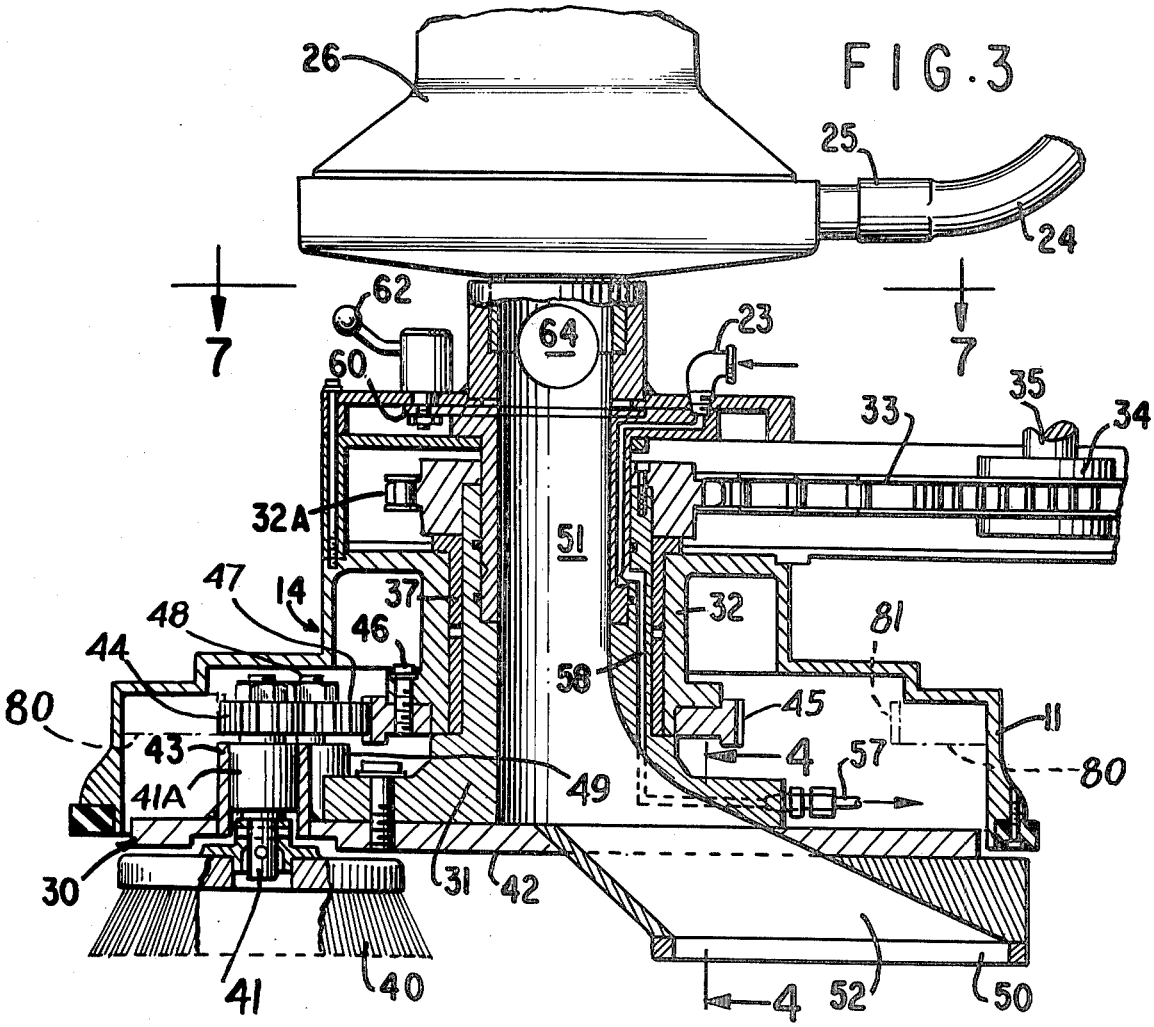
FIG. 3 is a vertical sectional view through the housing and rotor of the cleaning device and is taken along the line 3—3 of FIG. 6.
Figure 4:
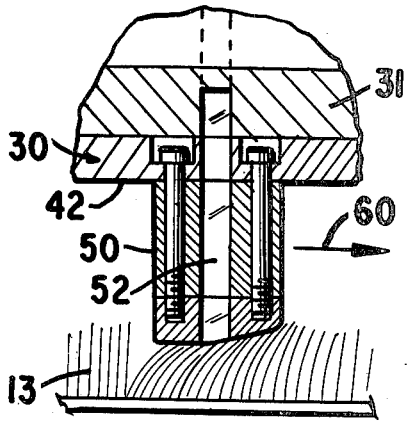
FIG. 4 is a sectional view of a suction nozzle, being taken along the line 4—4 of FIG. 3.

The handle assembly 17 is shown in greater detail in FIG. 2 and comprises a pair of handles 18 which are held by the operator during the manipulation of the machine. The handles have operating levers 19 and 20 pivotally mounted thereon for the convenience of the operator. Control handle 20 regulates flow of cleaning or rinsing fluid through line 21 which passes through tubular support 22 secured to the handle assembly and this line 21 is connected to the top of the enclosure 14 at the elbow 23 (FIG. 3). A conventional quick connection 21A (FIG. 2) can be used for supplying the cleaning or rinsing liquid.

The other control handle 19 can be used to regulate the starting and stopping of the motors through switch means 19A.

An exhaust pipe or tube 24 is also mounted on the handle assembly and is connected to the top of the enclosure at a connection 25 (FIGS. 1, 3). A suction is created by the motor and fan assembly 26. The cleaning fluid is drawn off through the outlet connection 25 and through the discharge hose 24. The frame 15 may also be supported by a swivel wheel 27.

A large rotor 30 (FIG. 3) is mounted within the housing 11, and to this rotor is attached a hub member 31 journaled within frame portion 32 in the enclosure 14. The upper end of a cylindrical sleeve extension of the hub member 31 is provided with a pulley 32A which is drivingly connected by a drive belt or chain 33 to a drive pulley or gear 34 mounted on an output shaft 35 of an electric motor 36 (FIG. 1) mounted on the frame 15. This motor 36 serves to turn the large rotor 30. The cylindrical sleeve extension of the rotor hub member 31 (FIG. 3) is journaled in a bushing 37.

Figure 6:
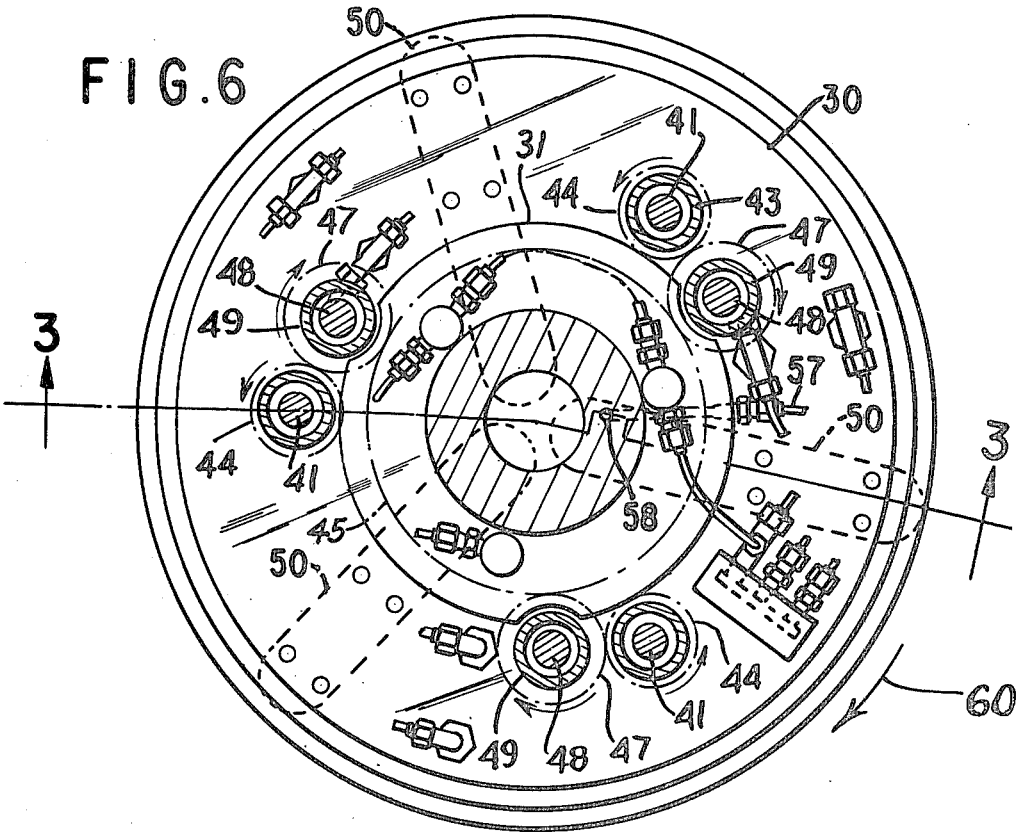
FIG. 6 is a top plan view of the rotor of the cleaning device with the brush rotating drive means being shown in dash and dotted outline.

A plurality of circular brushes 40 (FIG. 3) are located near the underside 42 of the rotor 30, these brushes being mounted by means of shafts 41 journaled in bearings 41A in sleeves 43 welded or secured to the inner face of the rotor 30. As seen in FIG. 3, the upper end of a shaft 41 of a brush is provided with a gear 44 which meshes with an idler gear 47 which in turn meshes with a sun gear 45 fixedly mounted at 46 to the sleeve enclosure 32 of the frame. As shown in FIG. 6, all of the brush gears 44 are driven through similar idler gears 47 meshing with the sun gear 45 so that upon rotation of the rotor 30, the brushes 40 will be rotated as shown by arrows 59 in the opposite direction from the turning motion 60 of the rotor 30. Each idler gear 47 is mounted on a freely rotatable shaft 48 (FIG. 3) which is journaled in a bearing (not shown) supported by a mounting sleeve 49 secured as by welding to the rotor 30. The mounting sleeve 49 for the idler gear shaft bearing is similar to the mounting sleeve 43 for the bearing 41A of the brush shaft 41. In effect, the fixed sun gear 45 and the idler gears 47 and brush gears 44 serve as rotating drive means for contrarotating the brushes with respect to the rotor 30.

Moreover, in this embodiment, the brush rotating means 45, 47, 44 are arranged to rotate the brushes 40 at significantly higher revolutions per minute (RPM) than the rotor 30 for reasons as explained later. For example, I have found it to be advantageous to use a sun gear 45 with a relatively large diameter, i.e., of approximately seven inches and having a relatively large number of teeth, i.e., 127 teeth, and to use brush gears 44 with a relatively much smaller diameter, i.e., a diameter of only approximately $\frac{7}{8}$ths of an inch and having relatively few teeth, i.e., fourteen teeth each. The intervening idlers 47 have an intermediate diameter, i.e, of approximately two inches with 32 teeth each.

Using this arrangement, the gear ratio between the sun gear 45 and the brush gears 44 is greater than eight to one. Since the brush gears are revolving around the fixed sun gear and since they are contrarotating, they rotate more than seven times with respect to the rug 13 for each full rotation of the rotor 30. Accordingly, with a rotor speed of approximately 30 RPM, the brushes themselves are rotating at approximately 230 RPM relative to the rug, thereby producing a very vigorous brush scrubbing action.

As seen in FIG. 6, each of the brushes 40 in its peripheral region, i.e., in the region where the arrow 59 is shown is travelling very rapidly in the opposite direction from the direction of travel of the periphery of the rotor assembly as a whole, which is rotating in the direction 60. As a result, the brush elements or bristles in the peripheral region travelling very rapidly in a backward direction 59 relative to the rotor tend to lift up and to flip over the matted pile of the rug thereby exposing and scrubbing its underside. Then, in the interior regions 54 where the brush elements or bristles are travelling in the same direction as the rotor, they flip the pile back into its original position for scrubbing it on the other side. Thus, the pile of the rug advantageously becomes thoroughly scrubbed on its underside as well as on its upper side. An advantageous cyclic scrubbing action is produced flipping the matted pile back and forth many times during one pass of the machine.

In this illustrative embodiment, the overall diameter of the rotor 30 is approximately three times the diameter of each of the individual rotating brushes 40. Consequently, if the brushes 40 rotate at an RPM rate only approximately three times the RPM rate of the rotor, then the peripheral region 59 of each brush will be approximately stationary relative to the rug as the rotor is turning in the direction 60.

In order for the peripheral region 59 of each brush to be travelling backwardly relative to the rug at approximately the same speed as the periphery of the rotor is travelling forward for providing a quick and effective pick up and flip over of the rug pile for effectively exposing and cleansing its underside, then the RPM rate of the brushes is advantageously approximately six times the RPM rate of the rotor (thereby calling for a gear ratio between sun gear 45 and brush gear 44 of seven-to-one, i.e. seven teeth on the sun gear for each tooth on the brush gear). As explained above, I have found that an RPM rate of the brushes approximately seven times the RPM rate for the rotor works very advantageously in cleansing the rug pile.

Also positioned on the underside 42 of the rotor 30 are suction nozzles 50 spaced between the brushes (FIG. 5) and communicating with a passage 51 within the cylindrical extension of the hub member 31. Passage 51 communicates at its upper end with the discharge hose 24. The suction nozzles 50 are fixed to the rotor 30 and each is provided with a relatively narrow slot 52.

Figure 10:
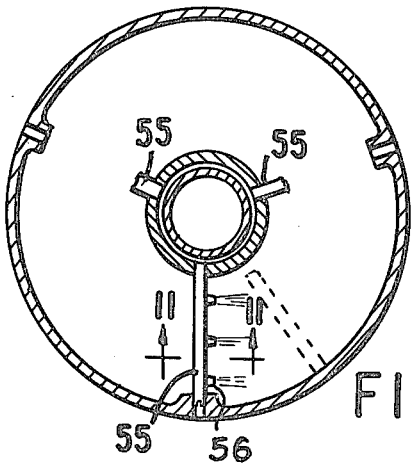
FIG. 10 is a sectional view showing the arrangement of the nozzles.
Figure 11:
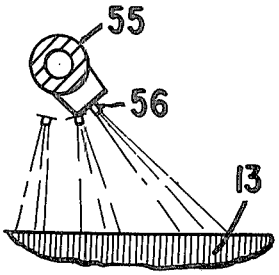
FIG. 11 is a sectional view taken along the line 11—11 of FIG. 10.

Also mounted on the underside of the rotor 30 is a plurality of spray nozzle means 55 (FIGS. 10 and 11) for dispensing cleaning or rinsing liquid. Each of the spray nozzle means can be mounted for angular adjustment as seen in FIGS. 10 and 11, so as to direct sprays of cleaning or rinsing liquid through individual nozzles 56 onto the rug 13 at different angles. The cleaning or rinsing fluid is conveyed to nozzle means 55 through lines 57 (FIG. 3) which extend upwardly in a passage 58 through the cylindrical extension of the hub member 31 and thus communicate with the elbow 23 which leads to a supply of cleaning or rinsing fluid.

Figure 5:
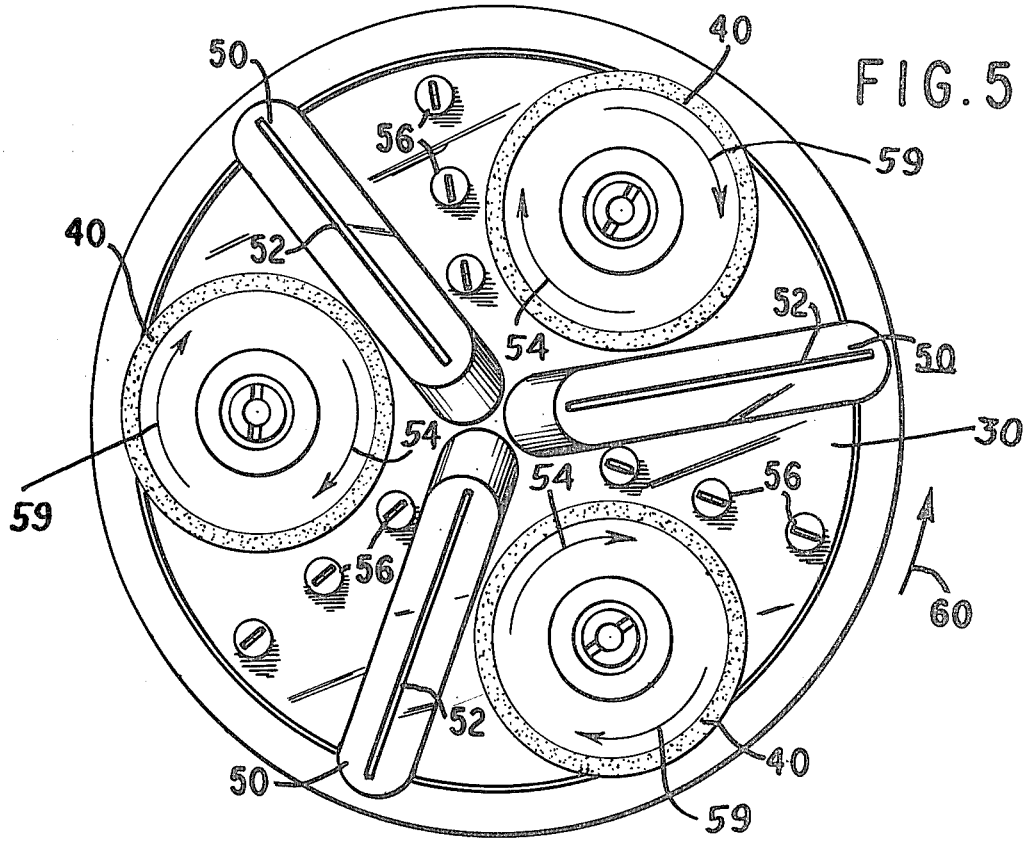
FIG. 5 is a bottom plan view of the rotor of the cleaning device.

During operation of the cleaning device, the rotor will rotate in the direction indicated by arrow 60 (FIG. 5). As the cleaning liquid is sprayed onto the rug through nozzles 56, as seen in FIG. 11, the rotating brushes 40 will thoroughly scrub the underside and upperside of the pile of the rug in conjunction with the liquid to loosen the dirt in or on the surface. The cleaning liquid and loosened dirt will then immediately be picked up by the next succeeding suction nozzle 50. Accordingly, the liquid-dwell-time is solely controlled by the machine, and not by the rate at which the operator advances the machine over the floor.

Figure 7:
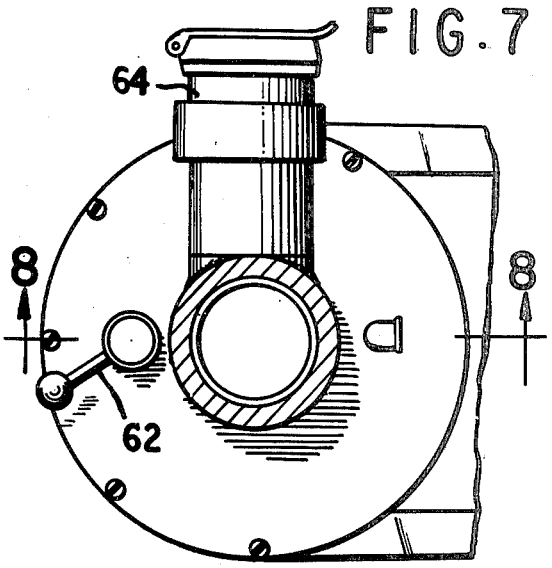
FIG. 7 is a plan sectional view taken along the line 7—7 of FIG. 3.
Figure 9:
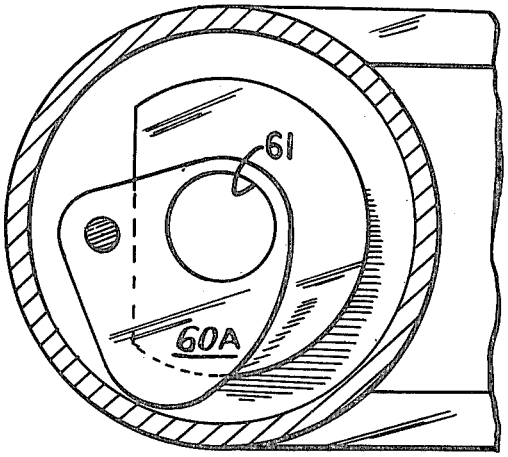
FIG. 9 is a plan sectional view taken along the line 9—9 of FIG. 8.
Figure 8:
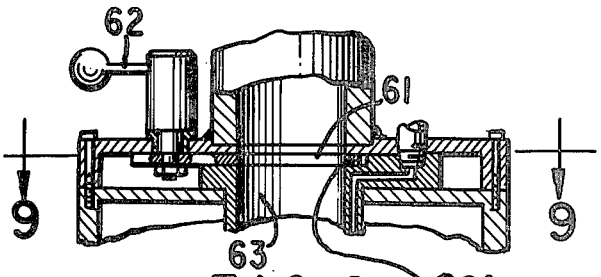
FIG. 8 is a partial elevational sectional view taken along the line 8—8 of FIG. 7.

If it is desired to use the motor and fan assembly 26 for vacuum cleaning, a valve plate 60A (FIGS. 8 and 9), having an aperture 61 therein, can be rotated by a handle 62, so that a passage 63 leading to passage 51 will be closed. A conventional cleaning hose (not shown) then can be inserted into a connection 64 (FIG. 7), and the motor 26 is activated without activating the rotor and brushes. The handle 62 is connected to the valve plate 60A in any suitable manner.

Figure 12:
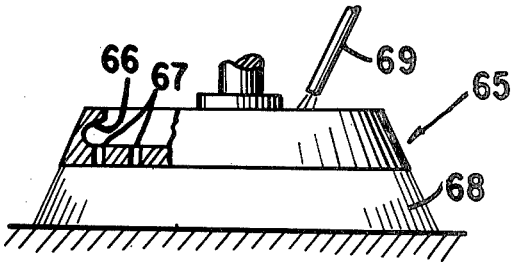
FIG. 12 is a fragmentary view of an alternate form of applying liquid.

As an alternative, the brushes can be replaced by a liquid dispensing brush, such as seen in FIG. 12, wherein the brush 65 has a cup-shaped portion 66 with apertures 67 therein leading to the bristles or brush elements 68. The cleaning liquid then is directed into the cup-shaped portion by suitable pipes 69 and is then dispensed through the downwardly directed apertures. Thus, the bristles or brush elements 68 become thoroughly moistened by the cleaning or rinsing liquid.

My presently preferred arrangement for feeding the liquid to each pipe 69 for supplying each brush 65 is to provide an annular trough or channel (not shown) in the upper surface or the hub 31 near its periphery. One or more feed tubes (not shown) are connected to the supply line 21 (FIG. 1). Such feed tubes lead down for flowing liquid directly into this distribution trough, then the liquid in this trough feeds by gravity down through the respective pipe 69.

Figure 13:
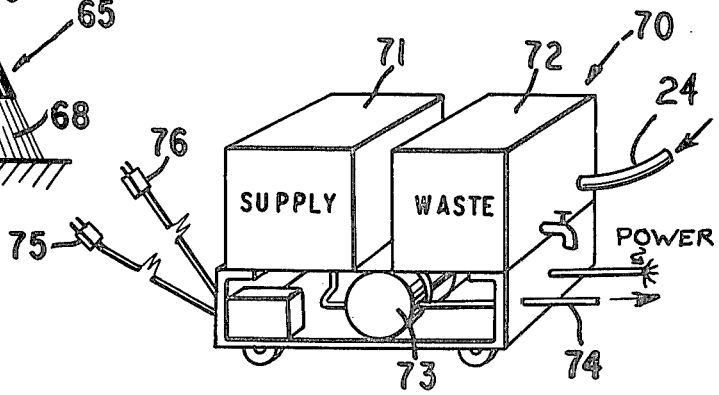
FIG. 13 is a schematic perspective of one form of cart support unit.

If desired, a cart 70 (FIG. 13) can be employed, the cart having a supply tank 71 and a waste tank 72 thereon. Pump 73 can be used to feed supply liquid to the connections 57 (FIG. 3) through a hose 74, or to the supply pipes 69 (FIG. 12). Power cords 75, 76 for the unit can be provided.

Instead of using a fixed sun gear 45 with idler gears 47, it is possible to use a fixed ring gear, as shown in FIG. 3 in dotted outline at 80 secured to the housing 11 and having internally located teeth 81. Then, the brush gears 44 are directly engaged with the ring gear 80 for producing contrarotation of the brushes relative to the rotor 30. It is desirable to have a relatively great number of teeth 81 on the ring gear 80 and relatively few on the brush gears 44 for producing a significantly higher RPM for the brushes than for the rotor for reasons as explained before.

It is my present preference to use a sun gear 45 with idlers 47 because this assembly is easier to align concentrically and less expensive than the assembly with a ring gear 80.

The motor and fan assembly 26 are shown mounted on the frame 11 of the apparatus for creating a suction within the passage 51 communicating with the narrow slots 52 of the suction nozzles 50. Then the discharge occurs through the hose line 24 into the waste section 72 (FIG. 3) of the cart 70. It is to be understood that a motor and fan assembly such as the assembly 26 can be located remotely from the frame 11 for serving as a remote source of suction, with a flexible suction hose line extending from this remote suction source to the upper end of the passage 51. For example, the remote suction source can be mounted on the cart 70 to be associated with the waste assembly 72. Such a suction source draws a suction through a flexible hose line communicating through a swivel connection with the upper end of the passage 51. An advantage of using such a remote suction source is that it reduces the overall weight of the apparatus 10 which the human operator is moving by the handles.

Thus, it can be seen that the present invention has provided cleaning apparatus for surfaces through which eight a cleaning liquid or a rinsing liquid, such as water, can be applied onto the surface and then picked up by suction nozzles mounted upon the rotor. The orbital movement of the brushes immediately following the spray nozzles through which the cleaning or rinsing liquid is sprayed onto the surface ensures that the liquid will be worked thoroughly into the surface of the contrarotating brushes. The result is efficient cleaning operation which occurs independently of the skill of the operator.

It will be understood that changes in various details of construction and arrangement of parts may be made without departing from the spirit of the invention except as defined in the appended claims.

I claim:

1. In a surface cleaning and rinsing apparatus, improved means for cleaning and rinsing floor coverings, such as rugs, carpeting and the like, comprising:

a frame, a rotor at the bottom of said frame mounted for rotation relative to said frame, rotor drive means on said frame coupled to said rotor for turning it in a predetermined first direction, a plurality of brushes rotatably mounted on said rotor and being positioned below said rotor for scrubbing engagement with a floor covering to be cleaned and rinsed, each of said brushes having its axis of rotation spaced away from the axis of rotation of said rotor for revolving in an orbital motion about the axis of rotation of the rotor as the rotor is turned about its own axis, brush rotating means for contrarotating said brushes with respect to the rotor for rotating them in the opposite direction from the first direction of rotation of said rotor, said brush rotating means being arranged to rotate each of said brushes at a sufficiently high RPM rate in said opposite direction for causing the peripheral region of each brush furthest from the axis of rotation of said rotor to be travelling in the opposite direction over the floor covering from the direction of the travel of the periphery of the rotor for flipping over and scrubbing the underside of pile on the floor covering, liquid dispensing means operatively associated with said brushes for applying cleaning or rinsing liquid to the floor covering to be scrubbed by the brushes, and a plurality of suction nozzles on the underside of said rotor, said suction nozzles being spaced away from the axis of rotation of said rotor and one of said nozzles being positioned behind each of said brushes with respect to the direction of motion of said rotor relative to the floor covering for extracting liquid and loosened dirt from the floor covering immediately after scrubbing by the respective brush behind which the suction nozzle is positioned.

2. In surface cleaning and rinsing apparatus, improved means for cleaning and rinsing floor coverings as claimed in claim 1, in which:

said rotor has a diameter of approximately three times the diameter of said brushes, and said brush rotating means rotates each of said brushes at an RPM rate relative to the floor covering which is at least approximately six times the RPM rate of the rotor with respect to the floor covering.

3. In surface cleaning and rinsing apparatus, improved means for cleaning and rinsing floor coverings as claimed in claim 2, in which:

said rotor turns at a rate of approximately 30 RPM, and each of said brushes rotates at a rate of approximately 230 RPM.

4. In surface cleaning and rinsing apparatus, improved means for cleaning and rinsing floor coverings as claimed in claim 1, in which:

said liquid dispensing means operatively associated with each of said brushes include at least one downwardly aimed liquid spray nozzle positioned ahead of each of said brushes with respect to the direction of motion of said rotor for dispensing cleaning or rinsing liquid onto the floor covering ahead of the respective brush.

5. In surface cleaning and rinsing apparatus, improved means for cleaning and rinsing floor coverings as claimed in claim 1, in which:

said liquid dispensing means operatively associated with each of said brushes include liquid supply means for supplying liquid to at least one of said brushes, said brush having brush elements projecting downwardly therefrom for scrubbing the floor covering, and having at least one aperture in said brush for feeding the liquid to said brush elements.

6. In a surface cleaning and rinsing apparatus for cleaning and rinsing floor coverings, such as rugs, carpeting, and the like, improved cleaning means comprising:

a housing adapted to be disposed substantially parallel to the floor covering to be cleaned and being open on its lower side, a rotor mounted within said housing for rotation about an axis and being positioned near the open lower side of said housing, drive means coupled to said rotor for turning said rotor about its axis in a predetermined direction, a plurality of suction nozzles positioned on the underside of said rotor for engaging a floor covering and being spaced away from the rotor axis and spaced from each other, means on the rotor for connecting said suction nozzles to a source of suction, a plurality of brushes positioned on the underside of said rotor for engaging a floor covering, each brush being rotatably mounted for rotation about its own axis with respect to the rotor, and each brush having its own axis of rotation spaced away from the rotor axis, each of said brushes being positioned ahead of a respective one of said suction nozzles with respect to the direction of motion of the rotor relative to the floor covering, brush rotating means coupled to each of said brushes for rotating each of said brushes about its own axis in the opposite direction with respect to a floor covering from the direction of rotation of the rotor with respect to a floor covering, and for roating said brushes at a significantly higher RPM rate than the RPM rate of said rotor for causing the peripheral region of each brush furthest from the axis of rotation of said rotor to travel in the opposite direction relative to the floor covering from the direction of motion of the rotor relative to the floor covering for flipping over pile of the floor covering for scrubbing the underside of the pile, and liquid dispensing means operatively associated with said improved cleaning means for applying cleaning or rinsing liquid to the floor covering for scrubbing by said brushes.

7. In surface cleaning and rinsing apparatus, improved means for cleaning and rinsing floor coverings as claimed in claim 1, in which:

said suction nozzles extend down to the level of the bottom of the brushes for coming into intimate contact with the floor covering for effectively extracting the liquid and loosened dirt by direct application of the suction nozzles to the floor covering immediately after brush scrubbing has occurred.

8. In a surface cleaning and rinsing apparatus, improved means for cleaning and rinsing floor coverings, such as rugs, carpeting and the like, comprising:

a frame, a rotor at the bottom of said frame mounted for rotation relative to said frame, rotor drive means on said frame coupled to said rotor for turning it in a predetermined first direction, a plurality of brushes rotatably mounted on said rotor and being positioned below said rotor for scrubbing engagement with a floor covering to be cleaned and rinsed, each of said brushes having its axis of rotation spaced away from the axis of rotation of said rotor for revolving in an orbital motion about the axis of rotation of the rotor as the rotor is turned about its own axis, brush rotating means for contrarotating said brushes with respect to the rotor for rotating them in the opposite direction from said first direction of rotation of said rotor, said brush rotating means including a sun gear concentric with the rotor axis and fixed to the frame for remaining stationary with respect to the frame, a plurality of brush gears, each of said brush gears being concentric with the axis of rotation of respective one of said brushes and being connected to the brush for rotating the brush with respect to the rotor, a plurality of idler gears rotatably mounted on said rotor, each of said idler gears engaging with a respective one of said brush gears and with the sun gear for rotating the brushes in the reverse direction with respect to the direction of rotation of the rotor, liquid dispensing means operatively associated with said brushes for applying cleaning or rinsing liquid to the floor covering to be scrubbed by the brushes, and a plurality of suction nozzles on the underside of said rotor, said suction nozzles being spaced away from the axis of rotation of said rotor and one of said nozzles being positioned behind each of said brushes with respect to the direction of motion of said rotor relative to the floor covering for extracting liquid and loosened dirt from the floor covering immediately after scrubbing by the respective brush behind which the suction nozzle is positioned.

9. In surface cleaning apparatus for cleaning floor coverings, such as rugs, carpeting and the like, including a frame, a rotor near the bottom of said frame mounted for rotation relative to the frame, drive means on the frame coupled to the rotor for rotating it in a predetermined direction, a plurality of brushes rotatably mounted on said rotor and being positioned below said rotor for scrubbing engagement with a floor covering to be cleaned, each of said brushes having its axis of rotation spaced away from the axis of rotation of said rotor for revolving in an orbital motion about the axis of rotation of the rotor as the rotor is turned about its own axis, liquid dispensing means for applying cleaning liquid to the floor covering to be cleaned and a plurality of suction nozzles on the underside of said rotor, said suction nozzles being spaced away from the axis of rotation of said rotor and one of said nozzles being positioned rearward of each of said brushes with respect to the direction of motion of said rotor relative to the floor covering for extracting liquid and loosened dirt from the floor covering immediately after scrubbing by the respective preceding brush, the invention comprising:

contrarotating means coupled to each of said brushes arranged to rotate each of said brushes at a sufficiently high RPM rate relative to the rotor and in the reverse direction from the rotor for causing the peripheral region of each brush furthest from the axis of rotation of said rotor to be travelling in the opposite direction relative to the floor covering from the relative direction of travel of the periphery of the rotor for flipping over and scrubbing the underside of the pile on the floor covering.

10. In surface cleaning apparatus for cleaning floor coverings, such as rugs, carpeting and the like, the invention as claimed in claim 9, in which:

said brush contrarotating means contrarotates each of said brushes at an RPM rate relative to the floor covering which is at least approximately six times the RPM rate of the rotor relative to the floor covering.

11. In surface cleaning apparatus for cleaning floor coverings, such as rugs, carpeting and the like, the invention as claimed in claim 10, in which:

said rotor rotates at a rate of approximately 30 RPM relative to the floor covering.

12. In surface cleaning apparatus for cleaning floor coverings, such as rugs, carpeting and the like, the invention as claimed in claim 9, in which:

said suction nozzles extend down to the level of the bottom of the brushes for being in intimate contact with the floor covering for effectively extracting the liquid and loosened dirt by direct application of the suction nozzle to the floor covering.

13. In surface cleaning apparatus for cleaning floor coverings, such as rugs, carpeting and the like, the invention as claimed in claim 12, in which:

each of said suction nozzles has a relatively narrow suction slot in its bottom extending in a radial direction relative to the rotor, and the bottom surface of the suction nozzle slopes upwardly ahead of the slot with respect to the direction of motion of the nozzle relative to the floor covering.

14. In surface cleaning apparatus for cleaning floor coverings, such as rugs, carpeting and the like, the invention as claimed in claim 13, in which:

the bottom surface of the suction nozzle extends parallel with the floor covering behind the slot with respect to the direction of motion of the nozzle relative to the floor covering.

* * * * *